US006436457B1

(12) United States Patent
Poss

(10) Patent No.: US 6,436,457 B1
(45) Date of Patent: Aug. 20, 2002

(54) MICROWAVE COFFEE ROASTING DEVICES

(75) Inventor: Glen T. Poss, Nine Mile Falls, WA (US)

(73) Assignee: MoJocoffee Co., Park Ridge, IL (US)

( * ) Notice: Subject to any disclaimer, the term of this patent is extended or adjusted under 35 U.S.C. 154(b) by 0 days.

(21) Appl. No.: 09/579,597

(22) Filed: May 26, 2000

Related U.S. Application Data

(60) Provisional application No. 60/136,826, filed on Jun. 1, 1999.

(51) Int. Cl.[7] ..... B65D 85/00; H05B 6/00

(52) U.S. Cl. ..... 426/107; 99/DIG. 14; 426/118; 426/234; 426/242; 219/725; 219/727

(58) Field of Search ..... 426/107, 118, 426/234, 242, 243; 219/725, 727; 99/DIG. 14

(56) References Cited

U.S. PATENT DOCUMENTS 5,189,272 A * 2/1993 McDonald et al. ..... 219/727
5,244,682 A * 9/1993 Happ ..... 426/107
5,357,086 A * 10/1994 Tuopin et al. ..... 219/725
5,890,418 A 4/1999 Song ..... 99/286
5,919,390 A 7/1999 Childress ..... 426/107
5,996,480 A 12/1999 Kelley et al. ..... 99/286

* cited by examiner

*Primary Examiner*—George C. Yeung
(74) *Attorney, Agent, or Firm*—Cook, Alex, McFarron, Manzo, Cummings & Mehler, Ltd.

(57) ABSTRACT

A microwavable package for roasting coffee beans in which the package is shaped to be relatively larger in two dimensions than in a third dimension so that it presents a generally flat appearance or configuration. The package comprises a paper outer layer and an inner layer that includes a microwave susceptor. On the interior of the package a filter is provided, and a vent permits communication between the interior and exterior. The outer layer may be variously, kraft paper, bond paper, or filter paper. The inner layer may comprise a printed dipole antenna or a thin film conductor. The vent may be at least one perforation through both the inner and outer layers or a series of perforations. In a preferred embodiment, the package includes supports for maintaining the package in a generally vertical orientation when it is placed in a microwave to roast the coffee beans contained therein.

13 Claims, 4 Drawing Sheets

MICROWAVE COFFEE ROASTING DEVICES

CROSS REFERENCE TO RELATED APPLICATION

This application claims the benefit of Provisional Application Serial No. 60/136,826, filed Jun. 1, 1999.

BACKGROUND OF THE INVENTION

The present invention relates to a coffee roasting apparatus and, more specifically, to an apparatus for roasting green coffee beans in a microwave oven.

Coffee is the world's most popular beverage after water, with an estimated 400 billion or more cups consumed annually. According to popular legend, coffee was first discovered in northern Africa by a goat herder who observed his goats acting unusually frisky after eating the berries from a particular type bush. The goat herder tried eating the berries himself and discovered that they gave him renewed energy.

Monks, after hearing about these berries, dried them so that they could be transported to distant monasteries. The berries were reconstituted in water, the fruit eaten, and the liquid drank to provide heightened alertness for prayer time. Coffee eventually traveled to Turkey, where beans were first roasted, crushed, and boiled in water to create the first version of the beverage enjoyed by so many today.

Today, specialty coffees are typically roasted in small batches at 400° in either a drum-type roaster, in which the coffee beans are tumbled in a heated rotary drum, or a hot air roaster, in which coffee beans tumble on a current of hot air. During roasting, sugar and other carbohydrates within the bean become caramelized, which gives coffee its flavor and aroma.

Many misconceptions exist regarding the optimum time after roasting to enjoy coffee. Generally, coffee is best if used within a day or two after roasting. In contrast, green coffee beans are good for years if stored in a cool, dry environment. Unfortunately, the coffee that most coffee drinkers consume was roasted long before it was brewed. Even afficionados of coffee are not likely to regularly experience their beverage of choice at its peak of perfection.

To alleviate this problem, a number of consumer or home-use coffee roasting devices have been developed. Typically, these require at least one additional piece of equipment, which must be stored in the already crowded kitchen of the coffee drinker, who is already hard put to find space to store his grinder, press, espresso machine, and other assorted paraphernalia needed for enjoyment of his beverage of choice.

Accordingly, it is the object of the present invention to take advantage of the long shelf life of green coffee beans and better flavor by using the coffee beans shortly after roasting by providing for home roasting of coffee beans.

It is a further object of the present invention to provide a disposable device for roasting an amount of coffee to be consumed by an individual user within a day or two.

More specifically, it is an object of the present invention to provide such a roasting apparatus that roasts the coffee beans by use of microwave energy.

SUMMARY OF THE INVENTION

These objects, as well as others that will become apparent upon reference to the following detailed description and accompanying drawings, are accomplished by a microwavable package for roasting coffee beans in which the package is shaped to be relatively larger in two dimensions than in a third dimension so that it presents a generally flat appearance or configuration. The package comprises a paper outer layer and an inner layer that includes a microwave susceptor. On the interior of the package a filter is provided, and a vent permits communication between the interior and exterior. The outer layer may be variously, kraft paper, bond paper, or filter paper. The inner layer may comprise a printed dipole antenna or a thin film conductor. The vent may be at least one perforation through both the inner and outer layers or a series of perforations. The package may also be provided with a see-through window for viewing the coffee beans before the package is opened to determine the degree to which the beans have been roasted. In a preferred embodiment, the package includes supports for maintaining the package in a generally vertical orientation when it is placed in a microwave to roast the coffee beans contained therein.

DETAILED DESCRIPTION OF THE PREFERRED EMBODIMENTS

In accordance with the invention, a microwavable coffee roasting package is provided that comprises a paper envelope, which may be either coated or non-coated, with a microwave heating film on the inside of the areas where the green coffee beans will be located when the package is placed inside the microwave oven for roasting.

The microwave susceptor comprises a microwave heating film, such as a printed dipole antenna to receive the microwave energy and convert it to heat. The susceptor may also comprise a thin film conductor that operates in the same manner. Any susceptor may be used so long as it is an FDA approved material for use in contact with food. The microwave susceptor may also be printed directly on the package stock.

The package also contains cotton paper in woven or non-woven forms (or other suitable filter materials) along the one edge to act as a smoke filter and for holding the hulls or skins that leave the coffee beans while roasting. The package includes supports that help keep the package properly oriented in the microwave oven during the roasting of the coffee beans.

The orientation of the package for roasting is preferably substantially vertical in order to minimize hot spots. This is achieved by configuring the package to have essentially a single layer of coffee beans, which allows for even heating from the microwave heating material. The package may be horizontally oriented, but this may provide for less consistent results. A small gap between the green coffee beans and the filter material allows for the expansion of the beans that occurs due to roasting. The package also has one or more vent holes to allow the steam and smoke generated by roasting to escape.

Figure 1:
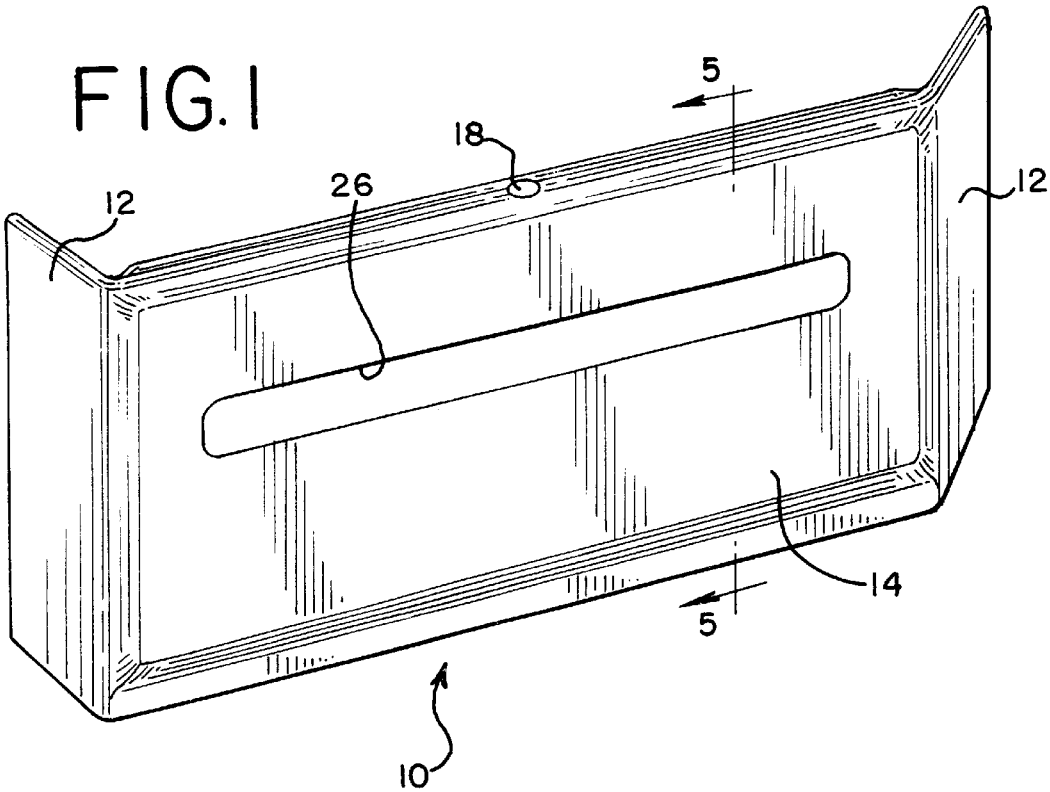
FIG. 1 is a perspective view of a first embodiment of a microwavable coffee roasting package according to the present invention showing the package disposed in a substantially vertical orientation.

Turning now to the figures of the drawing, there is seen in FIG. 1 a perspective view of a microwavable coffee roasting package, generally designated 10, according to the present invention. As can be seen in FIG. 1, the package 10 has a generally thin, vertical orientation and includes two supports 12 at either end that serve to maintain the package 10 in its vertical orientation.

Figure 2:
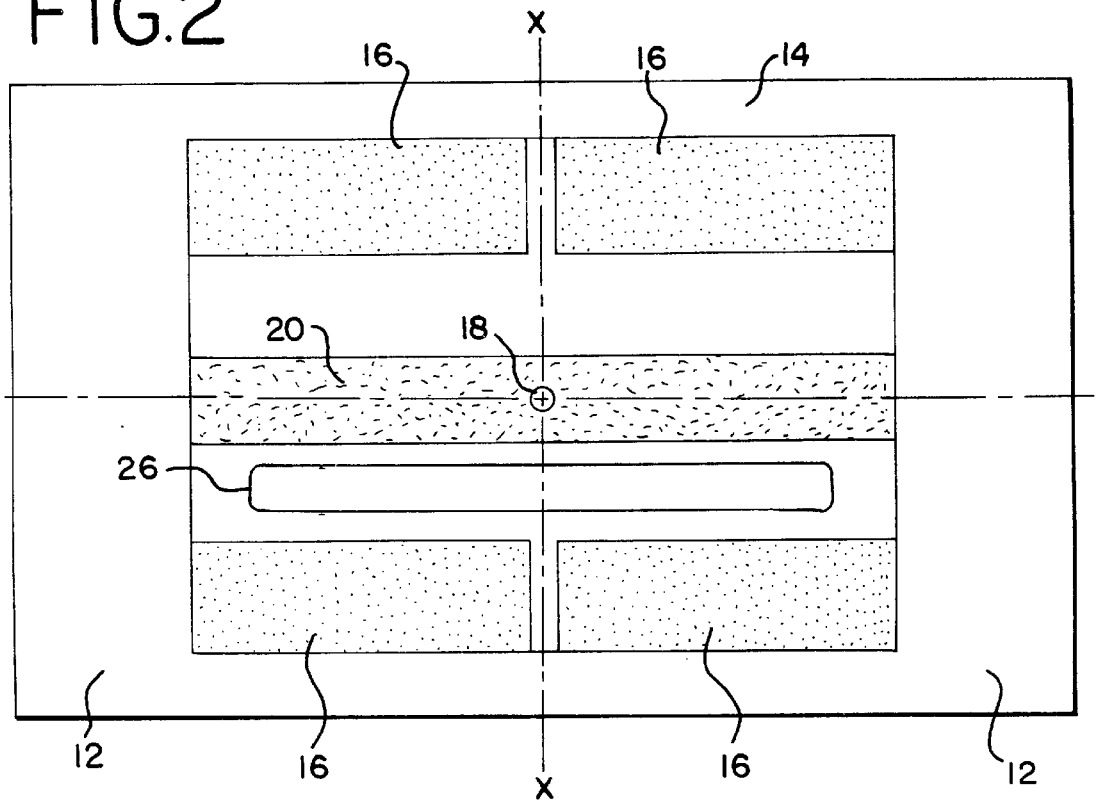
FIG. 2 is a plan view of the package of FIG. 1 with the package open and prior to final assembly in order to show detail.

In practice, the package 10 is preferably made of laminated paper and folded to the configuration shown in FIG. 1. With reference to FIG. 2, there is seen a plan view of the package prior to folding and receipt of the green coffee beans that are to be contained therein. The package includes an outer sheet or layer 14 of a neutral pH, zero acid paper such as kraft paper, bond paper or filter paper. The package has an inner layer adhered to the outer layer 14 including a microwave heating film 16. The film 16 is shown applied to the outer layer 14 in two discreet areas near the opposite edges of the outer layer 14. The microwave susceptor 16 is applied to the outer layer so that, when the package 10 is filled with the desired amount of coffee beans, the beans are essentially sandwiched between the microwave susceptor 16. The microwave heating film 16 may be directly applied to the outer layer 14, or may be formed on a separate layer that is then laminated or otherwise secured to the outer layer 14. For example, the microwave susceptor 16 may be a metallic ink printed onto a plastic film, which is then laminated to the outer layer.

Figure 5:
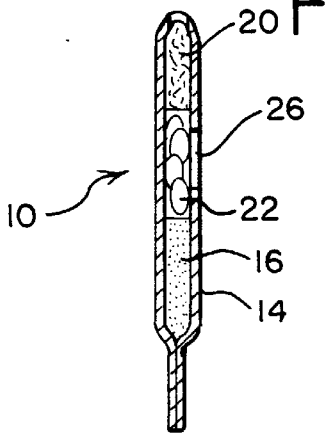
FIG. 5 is a cross-sectional view of the package of FIG. 1, taken along line 5—5 of FIG. 1.

In the center of the combined inner layer/outer layer is a vent hole 18. A strip of filter material 20, preferably made of cotton, extends down the center of the inner/outer layer laminate and covers the vent hole. The package is then folded about the X axis so that the microwave heating films are in face-to-face relationship, and the opposed edges are glued together, leaving the third side unglued so that the package can be filled with green coffee beans 22. After the package 10 is filled with a single layer of green coffee beans 22, the third edge is glued to complete the package. A cross-section of the package is shown in FIG. 5, including the green coffee beans 22 which are to be contained therein.

Figure 3:
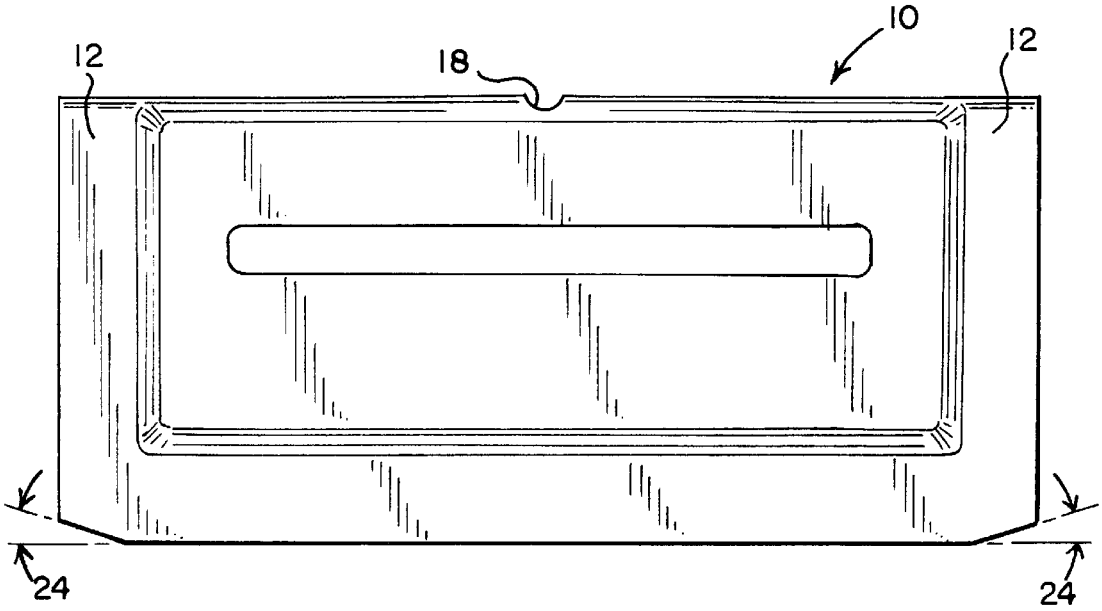
FIG. 3 is a plan view of the package of FIG. 1.
Figure 4:
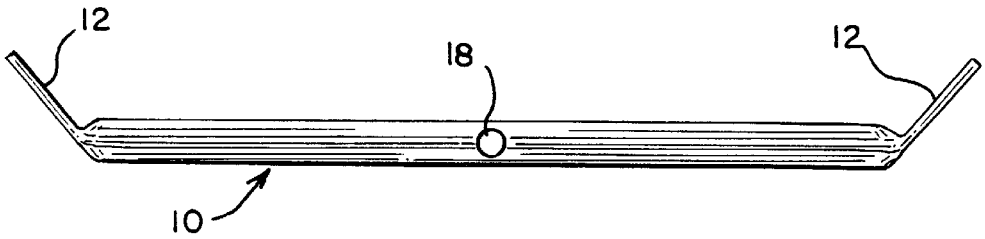
FIG. 4 is a top view of the package of FIG. 1.

With reference to FIG. 3, a completed package is seen. When properly oriented in the microwave oven for roasting, the vent 18 is at the top of the package (as seen in both FIGS. 1 and 3). As best seen in FIG. 3, the support portions 12 of the package may be trimmed at a slight angle 24 so that when the supports 12 are folded as shown in FIG. 1, the package 10 will tilt slightly towards the direction of the supports 12. This moves the center of gravity of the package more towards the center of the supports, thus creating a more stable package when in its vertical position.

Figure 6:
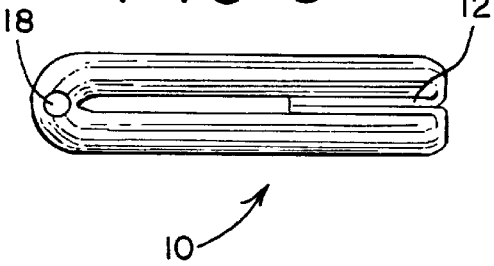
FIG. 6 is a top view of an alternate method of folding the package of FIG. 1 prior to placement in a microwave oven.

At the user's option, the supports 12 do not need to be used. Alternatively, the package 10 can be folded in half again to form the package 10 seen in top view in FIG. 6. This creates a larger base so that a more stable vertical orientation of the package is also attained. As is apparent, the package 10 could be folded to form an angle of less than 180° between the two halves and also provide for vertical support.

In the preferred embodiment, the package 10 may be provided with a window 26 in order to permit viewing of the roasted coffee beans 22 prior to opening the package in order to determine the degree to which the beans have been roasted. With reference to FIGS. 1 and 2, the window 26 is formed by a cut-out in the outer layer 14 in the upper portion of the package 10 between the microwave susceptor 16 and the filter 20, with the cut-out covered by a transparent film, preferably made of plastic. The film may be of the same type on which the microwave susceptor is printed.

When the package 10 is filled with green coffee beans 22 and oriented vertically (as seen in FIGS. 1 and 5), the window 26 is above the level of the beans in the package. Thus the beans 22 can only be viewed through the window 26 when the package is inverted. When the package is inverted to view the roasted beans, the position of the beans is shifted so that if further roasting of the beans is indicated, the beans will not be returned to their original position when the package is returned to its upright roasting position. This helps to insure more even roasting of the coffee beans.

Figure 7:
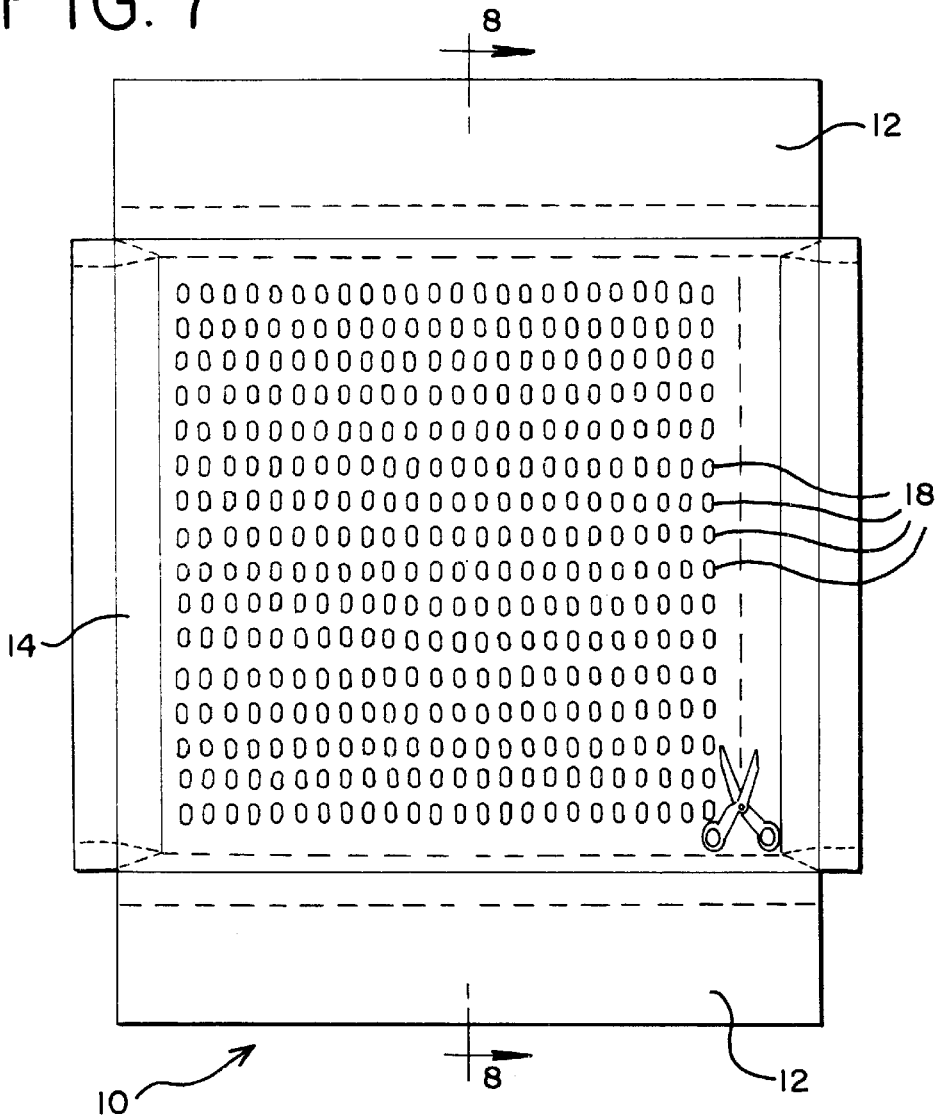
FIG. 7 is a plan view of an alternate embodiment of a microwavable coffee roasting package according to the present invention.
Figure 8:
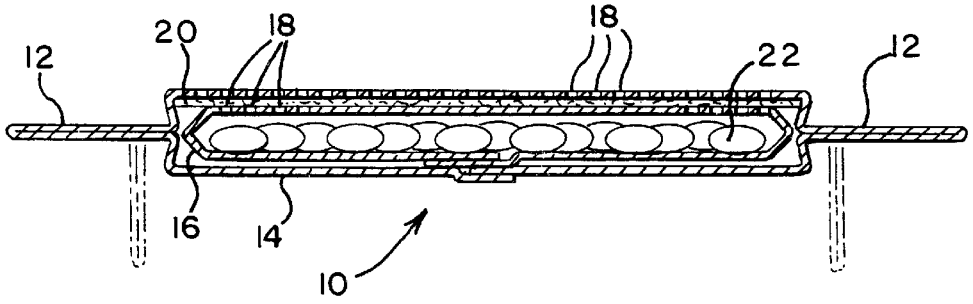
FIG. 8 is a cross-sectional view of the microwavable coffee roasting package of FIG. 7, taken along line 8—8 of FIG. 7.
Figure 9:
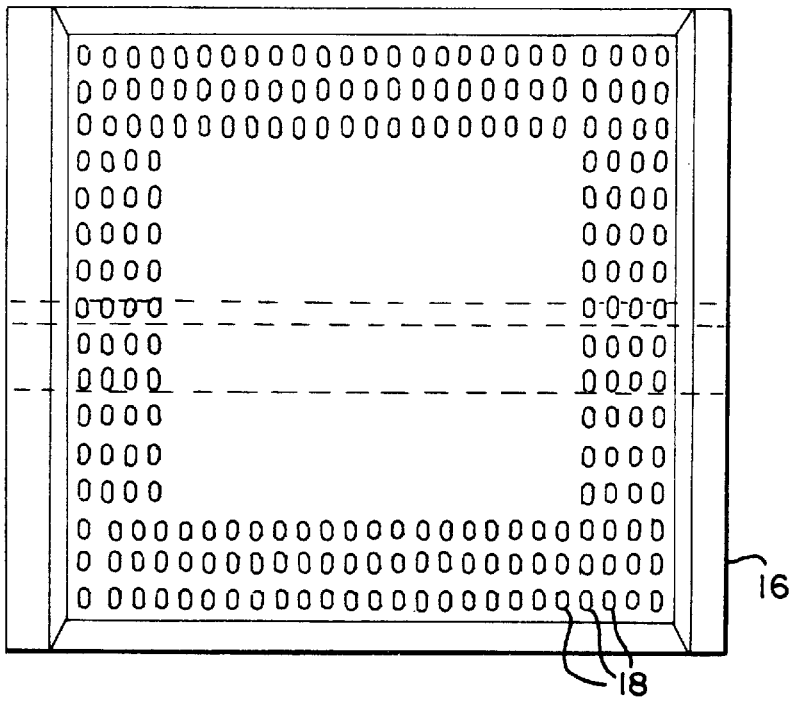
FIG. 9 is a plan view of the inner layer of the microwavable coffee roasting package of FIGS. 7 and 8.

With reference to FIGS. 7–9, there is seen an alternate embodiment of the invention in which the inner layer and outer layer are made separately and are formed to create a more box-like package. In FIGS. 7–9, like reference numerals are used to refer to elements corresponding to elements illustrated in FIGS. 1–6. In contrast to the embodiment of FIGS. 1–6, the embodiment of FIGS. 7–9 includes a series of perforations for the vent. On the inner layer, the perforations are extended only about the periphery of the inner package. A sheet of cotton fiber or filter paper is preferably secured to the inside of the outer layer to the perforated area. As can be seen in FIG. 8, the supports 12 could also be used to support the package off the floor of the microwave, with the package oriented in a generally horizontal rather than vertical direction.

Figure 10:
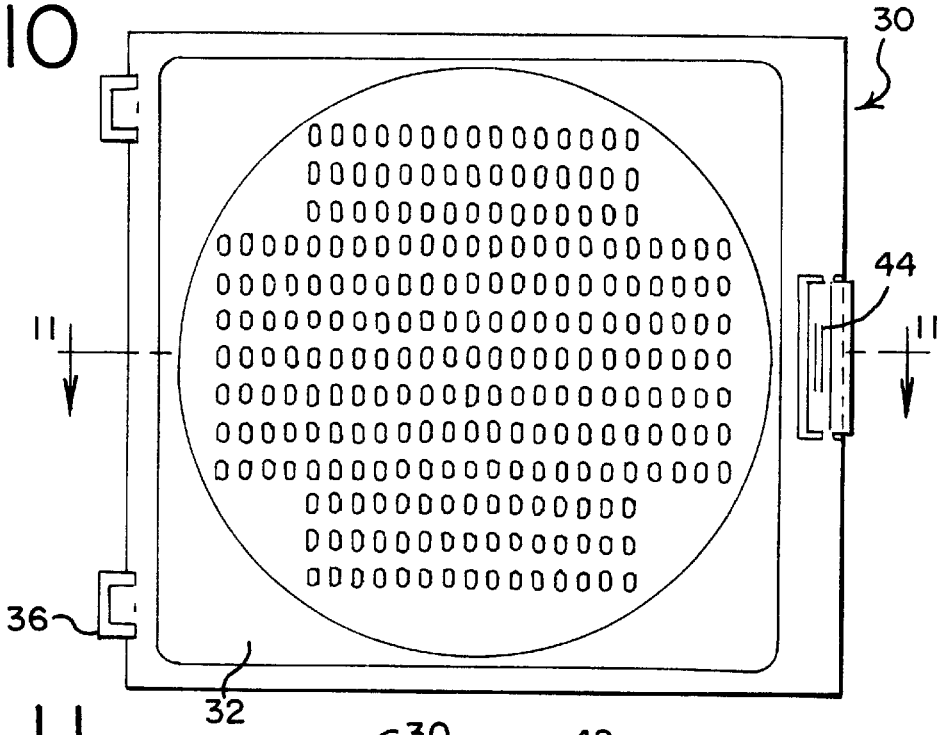
FIG. 10 is a plan view of a further embodiment of a microwavable coffee roasting package according to the present invention in which the package is reusable.
Figure 11:
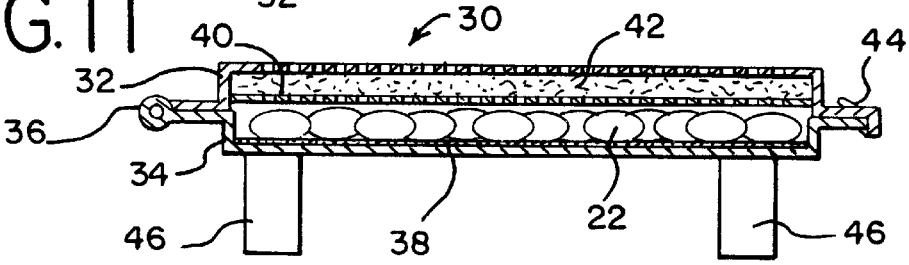
FIG. 11 is a cross-section of the microwavable coffee roasting package of FIG. 10, taken along lines 11—11 of FIGS. 10.

In a further aspect of the invention, a reusable microwavable coffee roaster 30 is seen in FIGS. 10 and 11. The device 30 includes a lid 32 and base 34 joined together by a hinge 36. The base 34 of the roaster 30 has an insert 38 of material such as iron oxide that becomes hot when hit with microwaves. The lid 32 of the device also has an insert 40 of the same or similar microwave susceptor material. Insert 40, however, has multiple holes that serve as vents. The lid 32 is also perforated with multiple holes. The insert 40 also serves to retain the filter material 42, which can be, but is not limited to, cotton. The lid 32 and base 34 are joined at one end by a molded hinge 36 and at the opposite side by a molded latch 44. The base also has a plurality of legs 46 (at least three) to raise the unit off the bottom of the microwave oven floor.

In use, the device 30 is opened, and a measured amount of green coffee beans are placed in the lower half, with the recess serving to measure the correct amount of beans. The lid 32 is closed, and the roaster 30 is placed inside a microwave oven and hit by microwaves. The holes in the upper heating element 40 allow the smoke and water vapor from the roasting beans to go through the filter and the holes in the lid 32. The resultant direct and convection heat serves to roast the green coffee beans. After roasting is completed, the device 30 is removed from the microwave and the beans removed. The roasted beans can now be ground or stored.

Accordingly, a coffee roasting package and a method of roasting green coffee beans using a home microwave oven has been provided. The combination of direct heating of the green coffee beans by the microwaves and the use of materials that convert microwave energy into heat result in the selective and controllable roasting of the coffee beans. The design of the packaging and the orientation of the package in the microwave oven achieve this. The device may be constructed as a disposable pre-loaded package or as a reusable consumer-filled device. While the invention has been described in terms of certain preferred embodiments, there is no intent to limit it to the same. Instead, the invention is defined by the scope of the appended claims.

What is claimed:

1. A microwavable package for roasting coffee beans, the package shaped to be relatively larger in two dimensions than in a third dimension so as to present a generally flat appearance, the package comprising:

a paper outer layer;

an inner layer including a microwave susceptor;

a filter secured to the inner layer; and a vent permitting communication between the interior of the package and the exterior, the vent being covered by the filter.

2. The microwavable package of claim 1 wherein the outer paper layer comprises kraft paper.

3. The microwavable package of claim 1 wherein the outer paper layer comprises bond paper.

4. The microwavable package of claim 1 wherein the outer paper layer comprises filter paper.

5. The microwavable package of claim 1 wherein the inner layer comprises a printed dipole antenna.

6. The microwavable package of claim 1 wherein the inner layer comprises a thin film conductor.

7. The microwavable package of claim 1 wherein the vent comprises at least one perforation through the inner and outer layers.

8. The microwavable package of claim 1 wherein the package is sized in its third dimension to accommodate a single layer of roasted coffee beans.

9. The microwavable package of claim 1 wherein the outer and inner layers are laminated together to form a sheet having peripheral edges, the sheet being folded back on itself and sealed at its peripheral edges.

10. The microwavable package of claim 1 wherein the package comprises a box.

11. The microwavable package of claim 1 wherein the package includes a transparent window to permit viewing of its contents.

12. The microwavable package of claim 1 wherein the package shaped to be relatively larger in its height and width dimensions than in its thickness dimension, the package further comprising supports for maintaining the package in a generally vertical orientation.

13. A microwavable package for roasting coffee beans, the package being shaped to be relatively larger in its height and width dimensions than in its thickness dimension, the package comprising:

a paper outer layer;

an inner layer including a microwave susceptor;

a filter secured to the inner layer;

a vent permitting communication between the interior of the package and the exterior, the vent being covered by the filter; and at least one support for maintaining the package in a generally vertical orientation when placed in a microwave oven for roasting coffee beans.

* * * * *